US006145851A

United States Patent [19]

Heber

[11] Patent Number: 6,145,851

[45] Date of Patent: Nov. 14, 2000

[54] ADAPTER FOR FIRMLY SECURING APPLIANCES ON FOLDABLE POCKET TOOLS

[76] Inventor: Gerald J. Heber, 16108 SE. 24th St., Bellevue, Wash. 98008

[21] Appl. No.: 09/347,708

[22] Filed: Jul. 3, 1999

[51] Int. Cl.[7] ..... B26B 11/00

[52] U.S. Cl. ..... 279/143; 7/118; 7/158; 7/165; 30/123; 279/75; 279/77; 279/83; 279/97; 279/145

[58] Field of Search ..... 7/118, 158, 165, 7/170; 30/7, 123; 81/488; 279/143, 145, 75, 77–80, 83, 97

[56] References Cited

U.S. PATENT DOCUMENTS

| | | | |
|---|---|---|---|
| 991,638 | 5/1911 | Pavelec | 30/123 |
| 1,814,274 | 7/1931 | Williamson | 279/79 |
| 1,915,370 | 6/1933 | Levy | 279/77 |
| 2,029,794 | 2/1936 | Rettstadt | 279/83 |
| 2,270,840 | 1/1942 | Allen | 279/79 |
| 2,714,026 | 7/1955 | Schultz | 279/83 |
| 2,833,032 | 5/1958 | Aciego | 30/1 |
| 4,692,073 | 9/1987 | Martindell | 279/75 |
| 4,995,128 | 2/1991 | Montgomery et al. | 7/127 |
| 5,280,659 | 1/1994 | Park | 7/128 |
| 5,450,775 | 9/1995 | Kozak | 81/440 |
| 5,481,949 | 1/1996 | Yen | 279/79 |
| 5,711,194 | 1/1998 | Anderson et al. | 7/118 |
| 5,809,600 | 9/1998 | Cachot | 7/128 |
| 6,000,080 | 12/1999 | Anderson et al. | 7/128 |
| 6,014,786 | 1/2000 | Cachot | 7/118 |

OTHER PUBLICATIONS

Sep. 27, 1999 Article From Newsweek on a New Swiss Army Knife.

Sep. 8, 1999 Leatherman Catalog (7 pages).

*Primary Examiner*—Steven C. Bishop

[57] ABSTRACT

A device that adapts a wide range of appliances such as drills, awls, screwdrivers and sockets to use with a multi-finctional pocket tool such as a pocket knife or other folding tool. The device firmly attaches the appliances to the multifunctional pocket tool so that the user can pull on the appliance in addition to pushing and turning. The adapter clamps firmly to flat blade such as a screwdriver blade by clamping to the blade with a screw and by forcing the sides of the adapter against the broad sides of the blade as well. The appliance is firmly retained by having a rigid thin rod or ball slide into the cavity in which the appliance is held to block its removal. The rigid thin rod or ball is easily moved out of the way to allow removal of the appliance.

6 Claims, 4 Drawing Sheets

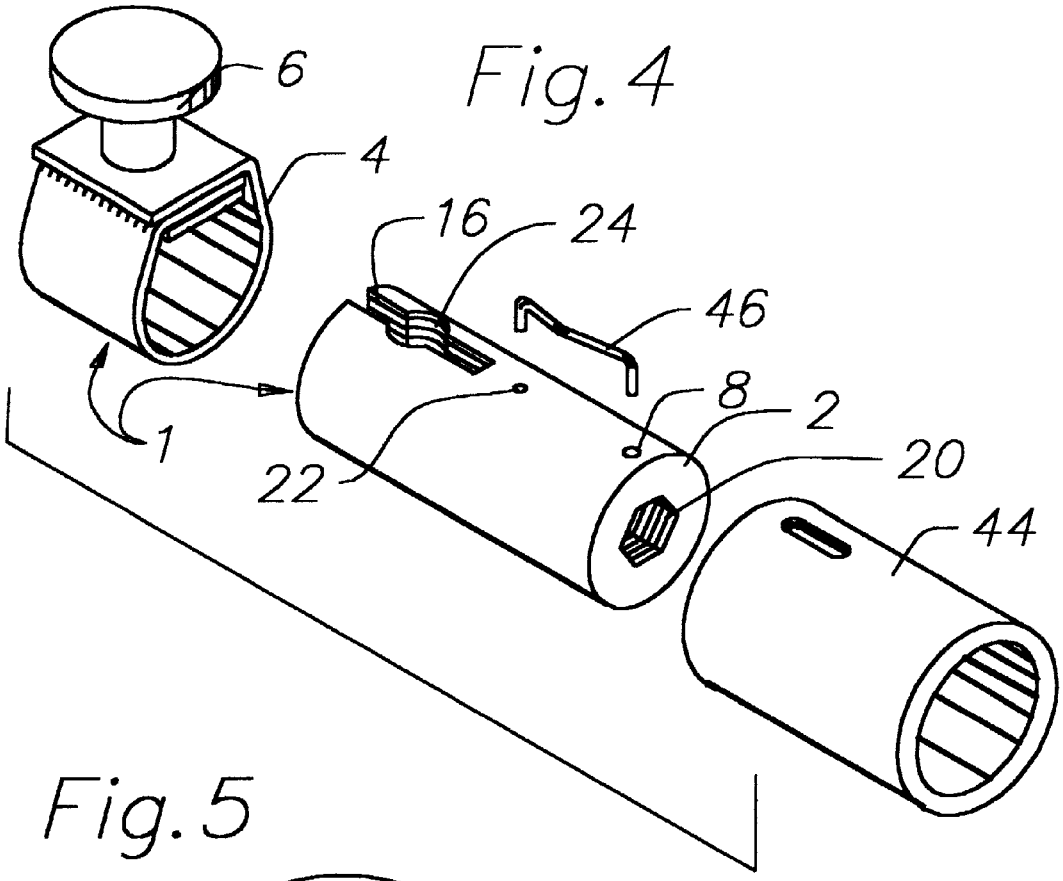
Fig. 4
Fig. 5
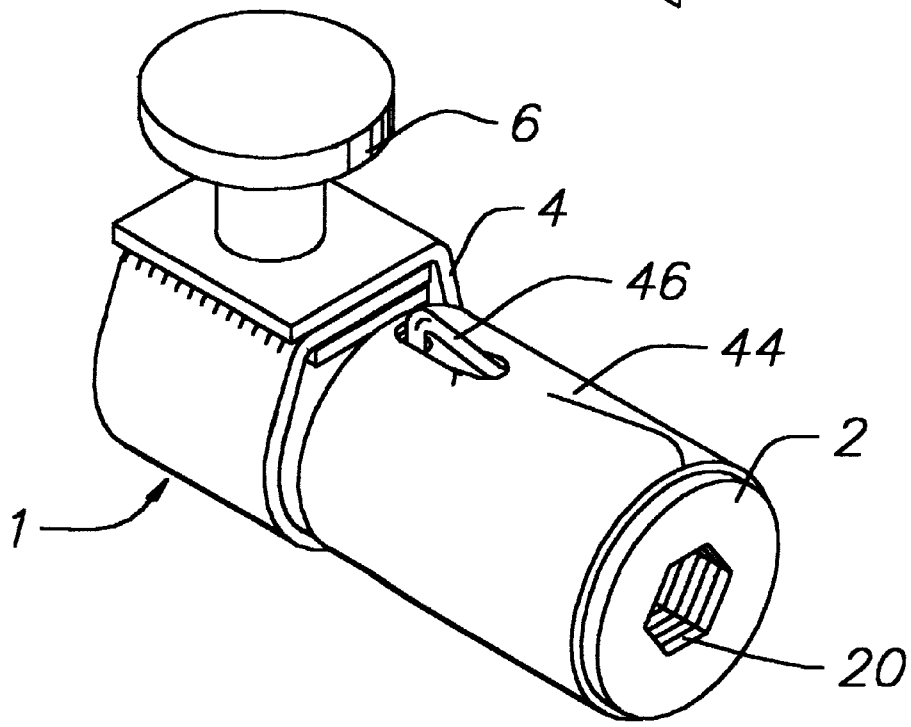

ADAPTER FOR FIRMLY SECURING APPLIANCES ON FOLDABLE POCKET TOOLS

BACKGROUND

1. Field of Invention

This invention relates to foldable tools, specifically to an adapter that serves as a means for firmly securing appliances that are pulled and could be turned and pushed, such as screwdrivers, saws, awls, drills and files, to a foldable pocket tool 2. Discussion of Prior Art Folding pocket knives and similar folding pocket tools are in common use. These foldable multifunctional pocket tools contain a wide variety of appliances such as knives, screwdrivers, saws, scissors, files, can openers, bottle openers, pliers and cork screws. Generally the appliances are permanently affixed or slipped in to or on to the foldable toot U.S. Pat. No. 5,711,194 to Anderson, et al. and U.S. Pat. No. 5,809,600 to Cachot show special features incorporated into pocket knives and foldable multifunctional pocket tools that allow them to accept loose appliances with hexagonal shanks. These inventions and similar tools suffer from a number of disadvantages:

(a) They allow the user to only push and turn an appliance. Any significant pulling of the foldable multifinctional pocket tool will dislodge the appliance from the foldable multifunctional pocket tool making it difficult or impossible to use such appliances as an awl, saw, file, drill or other similar style of tool (b) Provisions need to be built into the foldable multifunctional pocket tool on which they are used, which makes the tool larger and heavier.

(c) Use of the appliances is limited to the specific foldable multifunctional pocket tool for which it was designed.

(d) The dimensions of the folding tool, or blade, on the foldable multifunctional pocket tool onto which the adapter or appliance attach, need to be exact, as there are no means for adjusting or adapting the appliance holder.

OBJECTS AND ADVANTAGES

One object of this invention is to overcome the deficiencies of the prior art.

(a) To allow the user of the tool to firmly secure an appliance thereby permitting pulling, pushing and turning of said appliance enabling the use of appliances like an awl, saw, file, drill or other similar style of tool on a variety of foldable multifunctional pocket tools.

(b) To allow complete removal of the appliance holder when it is not needed to reduce the size and weight of the foldable multifunctional pocket tool (c) To allow the appliance adapter to be used on almost any foldable multifunctional pocket tool that has a flat blade such as but not limited to a screwdriver blade.

(d) To enable the use of a large variety of appliances to be used with a variety of foldable multifunctional pocket tools with a significant variation in the dimensions of the foldable tool to which the adapter attaches.

(e) To provide the advantages and objectives stated above at a low cost.

(f) Further objects and advantages of my invention will become apparent from a consideration of the drawings and ensuing descriptions.

DESCRIPTION OF DRAWINGS

FIG. 4 shows an exploded view of the adapter.

FIG. 5 shows a perspective of the adapter from the appliance end.

LIST OF REFERENCE NUMERALS

Figure 1:
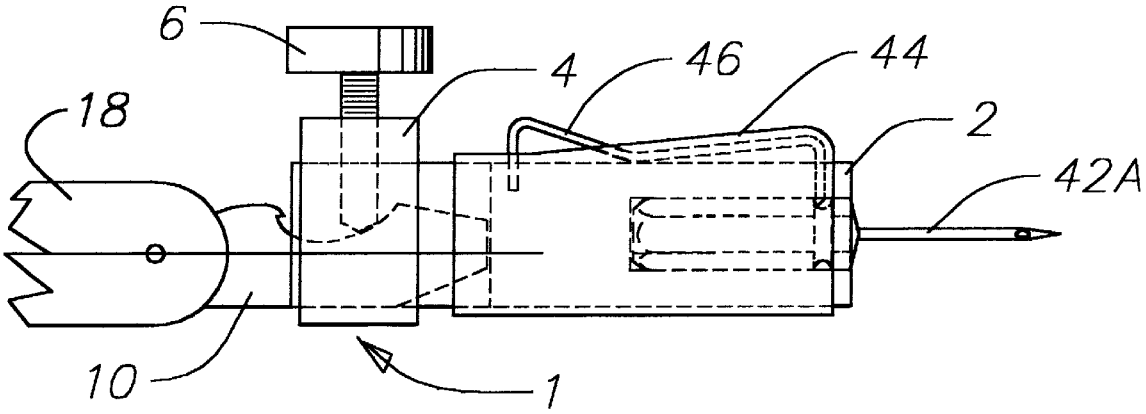
FIG. 1 shows a side view of the adapter attached to a multifunctional folding tool with an awl appliance inserted.

1 tool holder assembly
2 adapter main body for rocking retainer version
3 adapter main body for spring version
4 clamp body
5 adapter main body for coupling version
6 clamping screw
7 Coupling ring
8 retainer hole
9 partially conical interior bore
10 foldable tool
11 coupling balls
12 appliance holder
14 retention groove
15 ball hole
16 tool slot
17 coupling style appliance holder assembly
18 foldable multifunctional pocket tool
19 coupling spring
20 multifaceted concentric hole
22 locator hole
24 clamping hole
26 spring retainer
28 clearance slot
42-A awl appliance
42-B drill appliance
42-C file appliance
42-D saw appliance
44 flexible cylinder
46 rocking retainer

SUMMARY

In accordance with the present invention an adapter enables the use of a wide variety of appliances on most foldable tools that have a flat bladed screwdriver or similarly shaped tool. This invention firmly secures appliances to folding pocket tools thereby enabling the user to pull, push and turn the appliance without disengaging the appliance.

DESCRIPTION OF INVENTION

Figure 2:
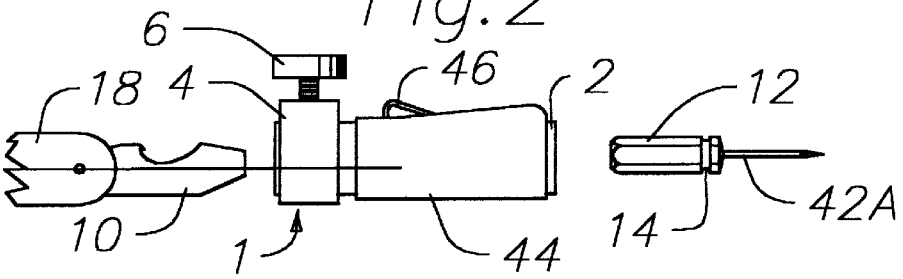
FIG. 2 shows a side view of the adapter with a multifunctional folding tool and awl appliance in position for attachment and insertion.

A typical embodiment of the invention installed on a foldable multifinctional pocket tool 18 with an awl appliance 42-*a* inserted is shown in FIG. 1. The pocket tool 18 is shown inserted in a tool slot 16. The foldable tool 10 is in contact with a clamping screw 6 which screws into a clamp body 4. The clamp body 4 encircles the adapter main body 2. The body 2 contains a locator hole 22 and a clamping hole 24. The rocking retainer 46 fits into the locator hole 22 and into the retainer hole 8 on the appliance side. Rocking retainer 46 is urged within the projected external surface of the appliance holder 12 such as by snapping into a retention groove 14 by a flexible cylinder 44. The flexible cylinder 44 surrounds the body 2 and can be made of plastic, rubber, or metal or any other elastic material. FIG. 2 shows the awl appliance 42-*a* and the foldable multifunctional pocket tool 18 disconnected from the assembled adapter consisting of the body 2, the clamp body 4 the clamping screw 6, the rocking retainer 46, and the flexible cylinder 44.

Figure 3:
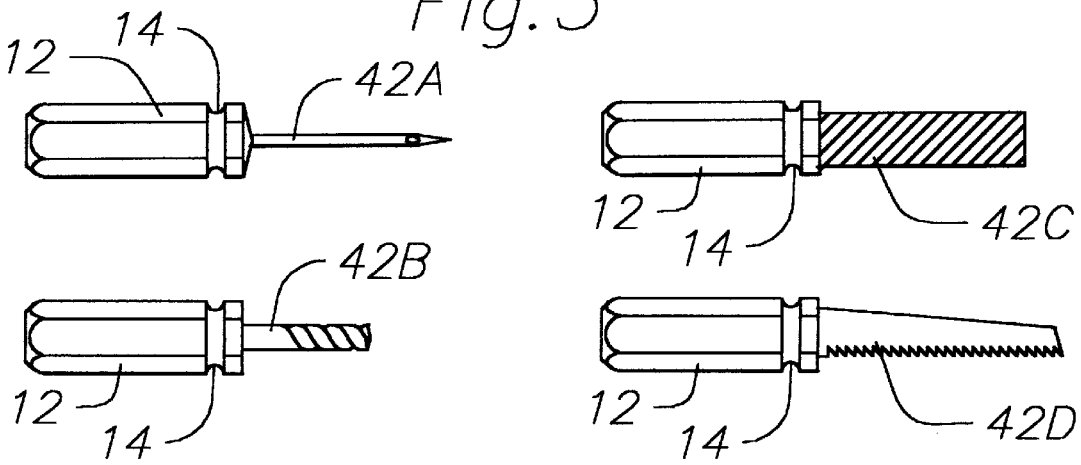
FIG. 3 shows some appliances that could be used in the adapter.

Some of the tools that can be typically used in the appliance adapter are shown in FIG. 3. The tools shown are an awl appliance 42-*a*, a drill appliance 42-*b*, a file appliance 42-*c* and a saw appliance 42-*d*.

FIG. 4 shows an exploded view of the invention. The body 2 has a tool slot 16 on the end where foldable tool 10 attaches. The slot 16 is slightly wider than the foldable tool 10. There is a clamping hole 24 through which the clamping screw 6 passes. There is a locator hole 22 in the body 2 in which the non-appliance end of the rocking retainer 46 resides. On the appliance end of the body 2 a retainer hole 8 extends from the outside surface of the body 2 through to the multifaceted hole 20. The appliance end of the rocking retainer 46 passes through the retainer hole 8. The adapter main body 2 can be made of metal or plastic with the preferred embodiment being aluminum. The clamp body 4 slides over the tool end of the body 2. The clamping screw 6 screws into the clamp body 4 and also passes into the clamping hole 24. The vertical ends of the rocking retainer 46 reside in the retainer hole 8 and the locator hole 22. The flexible cylinder 44 fits over the adapter main body 2 and over the appliance end of the rocker retainer 46. The flexible cylinder 44 does not contact the tool end of the rocker retainer 46. The preferred embodiment of the flexible tube 44 is a rubber tube. A tool holder assembly 1 consists of the tool end of the body 2, the slot 16, the clamping hole 24, the clamp body 4, and the clamping screw 6.

Figure 6:
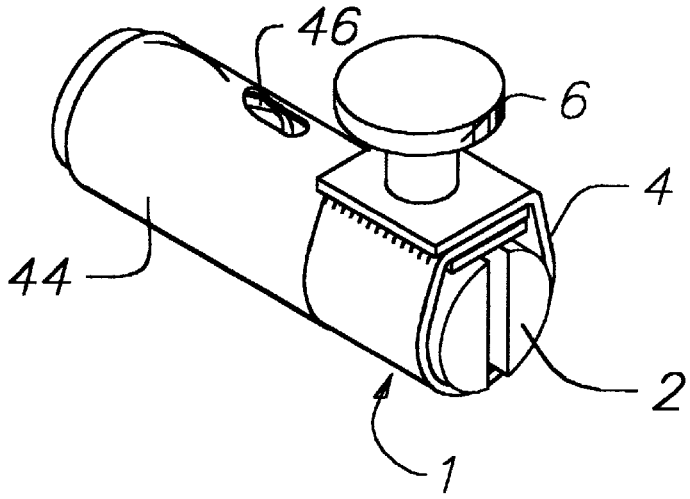
FIG. 6 shows a perspective view of the adapter from the multifunctional folding tool end.

FIG. 5 shows the appliance adapter in perspective from the appliance end. FIG. 6 shows the appliance adapter in perspective from the multifunctional pocket tool end.

Figure 7A:
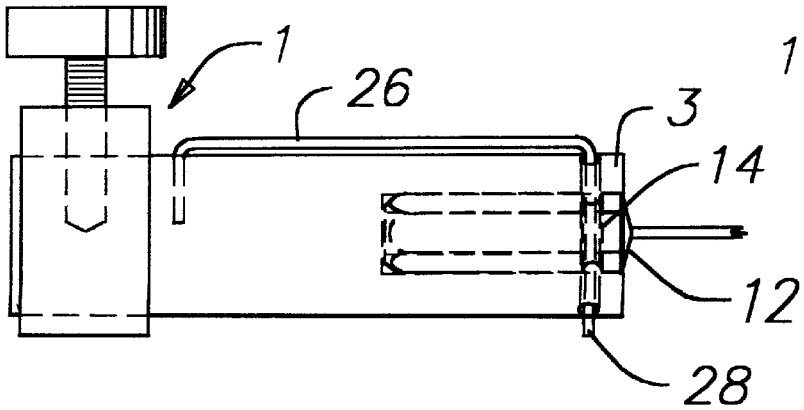
FIG. 7A shows a side view of the spring version of the invention.
Figure 7B:
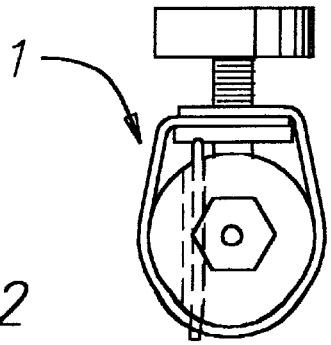
FIG. 7B shows an end view of the spring version of the invention.

FIG. 7A shows an alternate spring style embodiment of the invention consisting of the tool holder assembly 1 and a spring retainer 26 that attaches to the adapter main body for spring version 3 on the tool end and passes through a clearance slot 28 in the adapter main body spring version 3 on the appliance end. The spring retainer 26 is shaped such that it engages the appliance holder 12 by passing within the projected external surface of the appliance holder 12 such as by passing into the retention groove 14. Referring to FIG. 7B said multifaceted hole 20 is coaxial with the adapter main body for spring version 3 and is located on the appliance end of the adapter main body for spring version 3, The spring retainer can be made of any suitable spring material with stainless steel spring material being the preferred embodiment.

Figure 8A:
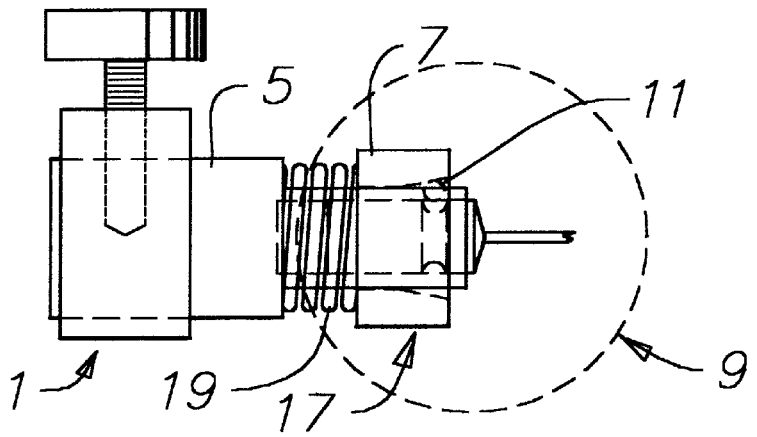
FIG. 8A shows a side view of the coupling embodiment of the invention.
Figure 8B:
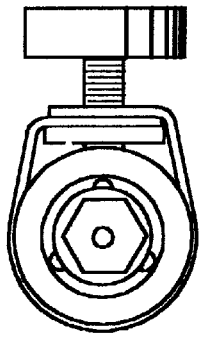
FIG. 8B shows an end view of the coupling embodiment of the invention.
Figure 9:
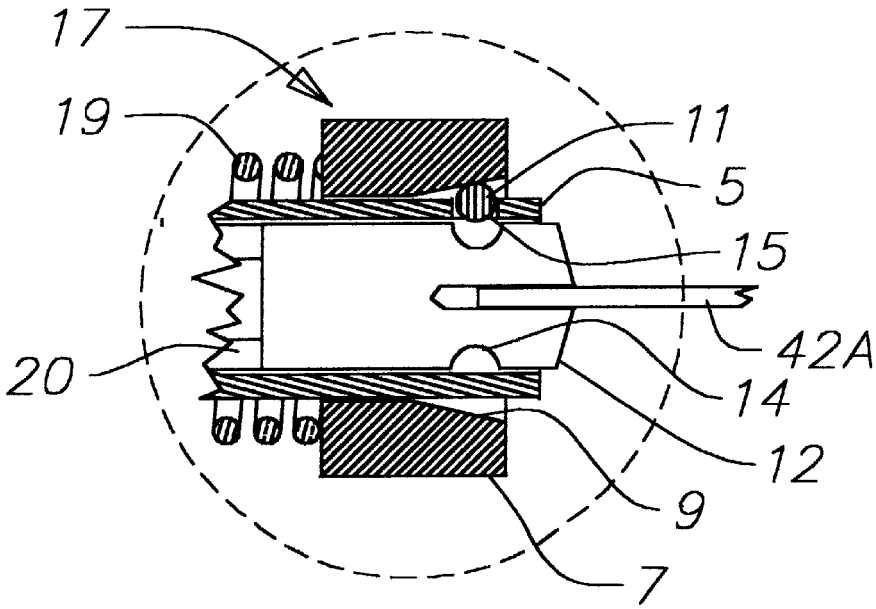
FIG. 9 is a cross sectional enlargement of a section of FIG. 8A.

FIGS. 8A, 8B and FIG. 9 show a quick coupling style embodiment of the invention. This embodiment shown in FIG. 8A consists of a tool holder assembly 1 and an adapter main body for coupling version 5, and as shown in FIG. 9, a coupling ring 7, a coupling spring 19, at least one ball hole 15, and at least one coupling ball 11. Each ball hole 15 has a coupling ball 11 in it. A coupling ring 7 surrounds the adapter main body for coupling version 5 and is in contact with the each coupling ball 11. The coupling spring 19 pushes the coupling ring 7 toward the appliance end.

OPERATION OF INVENTION

The adapter as shown in FIG. 1 is first slipped onto the foldable tool 10. Once the foldable tool 10 is fully inserted in the tool slot 16, the clamping screw 6 is tightened to secure the adapter to the foldable tool 10. The tightening of the clamping screw 6 presses the foldable tool 10 against the clamp body 4 and also causes the clamp body 4 to press in the sides of the adapter main body for rocking retainer version 2 adjacent to the tool slot 16 reducing the tool slot 16 width and pressing it against the foldable tool 10. The desired appliance is inserted into the multifaceted concentric hole 20 until the rocking retainer 46 moves into the retaining position within the projected external surface of the appliance holder such as by moving into the retention groove 14. The appliance is now firmly locked in place. The appliance is removed by pressing the tool end of the rocking retainer 46 so that the appliance end of the rocking retainer 46 pushes and displaces the flexible tube 44 allowing the rocking retainer 46 to clear the appliance holder 12 permitting removal of the appliance 42-*a*. The spring retainer embodiment as shown in FIG. 7A fastens to the foldable tool 10 in the same manner as the adapter shown in FIG. 1 as it has the same tool holder assembly 1. The appliance 42A is inserted into the multifaceted hole 20. As the appliance 42-*a* goes in it moves the retention spring 26 sideways until the spring moves into the retaining position within the projected external surface of the appliance holder 12 such as by moving into the said retention groove 14. The appliance is removed by moving the lower end of the retention spring 26 laterally, away from the center of the said adapter body for spring version 3 far enough to allow the appliance holder 12 to pass by the retention spring 26. The coupling version of the embodiment as shown in FIG. 8A attaches to the multifunctional pocket tool in the same manner as in the previously described embodiments. The appliance holder 12 is attached to the adapter by inserting the appliance holder 12 into the multifaceted hole 20 while moving the coupling ring toward the multifunctional pocket tool end compressing the coupling spring 19 while so doing. Moving the coupling ring 7 towards the multifinctional pocket tool end allows the coupling balls to move away from the center of the multifaceted hole 20 thereby allowing the entry of the appliance holder 12. When the appliance holder 12 is fully inserted in the multifaceted hole 20 the coupling ring is released and is moved towards the appliance end of the adapter by the coupling spring 19. As the coupling ring 7 moves toward the appliance end of the adapter it wedges the coupling balls in toward the center of the multifaceted hole 20 and into the retention groove 14 of the appliance holder 12. The appliance holder 12 is removed from the adapter by moving the coupling ring toward the multifunctional pocket tool end which allows the coupling balls 11 to move out of the retention groove 14, thereby freeing the appliance from the adapter.

CONCLUSION, RAMIFICATIONS, AND SCOPE OF THE INVENTION

Thus the reader can see that this invention provides a useful light weight and economical device that enables the users to utilize a larger variety of appliances on their multifinctional pocket tool than they can presently. The ability of this invention to transmit pulling forces from the multifunctional tool to the appliance enables the use of appliances such as an awl, a drill bit, a saw and other appliances.

While the above description contains many specificitites, these should not be construed as limitations on the scope of the invention, but rather as an exemplification of one preferred embodiment thereof. Many other variations are possible Accordingly, the scope of the invention should be determined not by the embodiments illustrated, but by the appended claims and their legal equivalents.

I claim:

1. An adapter that firmly secures an appliance to a wide variety of multifunctional foldable pocket tools comprising:

a. a main body with means for attaching said multifunctional foldable pocket tool on one end and positively attaching said appliance on the opposite end, and b. a means for easily locking and releasing said adapter to a wide variety of said foldable tools, and c. a means for locking said appliance to the adapter, whereby a variety of said appliances can be firmly attached to a variety of said multifunctional pocket tools so that the said appliances can be pulled, pushed and turned by a user and d. a retention device comprising a rocking spring shaped like the letter m, a flexible cylinder that urges the appliance end of said rocking spring into a retention groove of said appliance, and an adapter body, cylindrical in shape that has a radial hole for said rocking spring to pass through and a multifaceted concentric hole in which said appliance nests and a tool slot on the end opposite said multifaceted hole axially orientated which receives said multifunctional tool.

2. An adapter that firmly secures an appliance to a wide variety of multifunctional foldable pocket tools comprising:

a. a main body with means for attaching said multifunctional foldable pocket tool on one end and positively attaching said appliance on the opposite end, and b. a means for easily locking and releasing said adapter to a wide variety of said foldable tools, and c. a means for locking said appliance to the adapter, whereby a variety of said appliances can be firmly attached to a variety of said multifunctional pocket tools so that the said appliances can be pulled, pushed and turned by a user and d. a retention device comprising an L shaped spring in which one leg of said L shaped spring is in line with the long axis of said adapter and adjacent to said adapter and the other leg of said L shaped spring is essentially perpendicular to said long axis and passes through an oval hole in said adapter body and passes through said retention groove in said appliance.

3. An adapter that firmly secures an appliance to a wide variety of multifunctional foldable pocket tools comprising:

a. a main body with means for attaching said multifunctional foldable pocket tool on one end and positively attaching said appliance on the opposite end, and b. a means for easily locking and releasing said adapter to a wide variety of said foldable tools, wherein the adapter is attached to said foldable tool with a screw that clamps to said foldable tool and, also forcibly sandwiches said foldable tool by compressing the sides of said adapter body, and c. a means for locking said appliance to the adapter, whereby a variety of said appliances can be firmly attached to a variety of said multifunctional pocket tools so that the said appliances can be pulled, pushed and turned by a user.

4. The adapter of claim 3, wherein said appliance is locked to said adapter with a retention device comprising a rocking spring shaped like the letter m, a flexible cylinder that urges the appliance end of said rocking spring into a retention groove of said appliance, and an adapter body, cylindrical in shape that has a radial hole for said rocking spring to pass through and a multifaceted concentric hole in which said appliance nests and a tool slot on the end opposite said multifaceted hole axially orientated which receives said multifunctional tool.

5. The adapter of claim 3, wherein said appliance is locked to said adapter with a retention device consisting of an L shaped spring in which one leg of said L shaped spring is in line with the long axis of said adapter and adjacent to said adapter and the other leg of said L shaped spring is essentially perpendicular to said long axis and passes through an oval hole in said adapter body and passes through said retention groove in said appliance.

6. The adapter as in claim 3, wherein the appliance is locked to the adapter by at least one ball that travels in a hole in the adapter body and is wedged into a retention groove of the appliance holder by a coupling ring that is spring loaded and has a partial conical interior bore.

* * * * *